US005916077A

United States Patent [19]

Tang

[11] Patent Number: 5,916,077

[45] Date of Patent: Jun. 29, 1999

[54] COMPOSITE FIRE-PROOF, HEAT-BARRIER DOOR

[75] Inventor: Jung-Chaun Tang, Yun Lin Shiann, Taiwan

[73] Assignee: Chuan Mau Products, Ltd., Yun Lin Shiann, Taiwan

[21] Appl. No.: 08/803,317

[22] Filed: Feb. 20, 1997

[51] Int. Cl.[6] ..... E06B 3/08

[52] U.S. Cl. ..... 49/501; 52/232

[58] Field of Search ..... 49/501; 52/630, 52/803, 785, 829, 830, 232; 160/6, 7, 9

[56] References Cited

U.S. PATENT DOCUMENTS

| | | | |
|---|---|---|---|
| 603,442 | 5/1898 | De Man | 49/501 |
| 2,927,353 | 3/1960 | Snitker | 49/501 |
| 3,462,339 | 8/1969 | Poms | 52/232 |
| 4,307,543 | 12/1981 | Schulthess | 52/232 |
| 4,424,653 | 1/1984 | Heinen | 52/232 |
| 4,888,918 | 12/1989 | Green et al. | 49/501 |
| 4,937,978 | 7/1990 | Johansson et al. | 49/501 |
| 5,355,625 | 10/1994 | Matsuoka | 52/232 |
| 5,440,843 | 8/1995 | Lagenhorst | 52/232 |

FOREIGN PATENT DOCUMENTS

| | | | |
|---|---|---|---|
| 2600791 | 7/1977 | Germany | 49/501 |

*Primary Examiner*—Daniel P. Stodola
*Assistant Examiner*—Curtis Cohen
*Attorney, Agent, or Firm*—Bucknam and Archer

[57] ABSTRACT

A composite fire-proof, heat-barrier door which includes a casing trim and a fire proof door. The door panel of the fire proof door are made from a stainless plate. The inner walls of the door panels are provided with a rigid heat barrier fire proof plate. The central portion of the fire proof door is provided with a heat preserving material. The peripheral edges of the fire proof door is provided with fire proof heat barrier clearance. When a fire accident occurs, the smokes and fire can be effectively prevented from coming in by the novel composite fire proof heat barrier door.

5 Claims, 3 Drawing Sheets

COMPOSITE FIRE-PROOF, HEAT-BARRIER DOOR

FIELD OF THE INVENTION

The present invention relates to a door, more particularly, to a composite fireproof, heat-barrier door wherein the fire and heat generated can be effectively isolated. The frame of the door is laminated with stainless steel and heat sensitive expanding seal. The front and rear door panels are also made from stainless plates and rigid fire-retarding and heat-barrier material layer is disposed between the front and rear panels. The side portion is provided with heat barrier clearance. When a fire accident occurs, the fire, smoke and heat can be effectively isolated by the door made according to this invention.

DESCRIPTION OF PRIOR ART

Generally, the safety door installed in a building is configured with a single sheet of steel plate. The single steel sheet is not rigid enough to sustain impact or bumping. Since it may readily be deformed, it may not be completely closed as it shall. In case of fire, fire and smoke may get in through the clearance between the door and trim. On the other hand, the single steel sheet can not sustain the high heat during a fire accident. In light of this, life and property can not be effectively protected by this simple steel door.

SUMMARY OF THE INVENTION

It is the object of this invention to provide a composite fire-proof, heat-barrier door wherein the air tightness can be establish between the door and trim during a fire accident, consequently, fire and especially smoke will be prevented from coming in. Furthermore, the composite door has excellent heat-resistance so that the door will not be damaged by the high heat.

Description of Numerals

| | | | |
|---|---|---|---|
| casing trim | 1 | fire proof door | 2 |
| corner pillar | 11 | protecting frame | 12, 13 |
| fire proof expanding seal | 14 | recessed cutout | 111 |
| seal groove | 112 | curve portion | 121, 122 |
| groove | 113, 114 | curve portion | 131, 132 |
| retaining groove | 115, 116 | fire-proof heat barrier expanding membrane | 123, 133 |
| fire proof door | 2 | door panel | 21, 22 |
| relative curve | 211, 221 | rigid heat barrier fire proof plate | 23, 24 |
| high-duty foam heat barrier plate | 25, 26 | wood structure | 27 |
| heat preserving heat barrier material | 28 | rigid sealing plate | 29 |
| groove | 291 | screw | 30 |
| heat proof heat barrier clearance | 251 | | |

Figure 1:
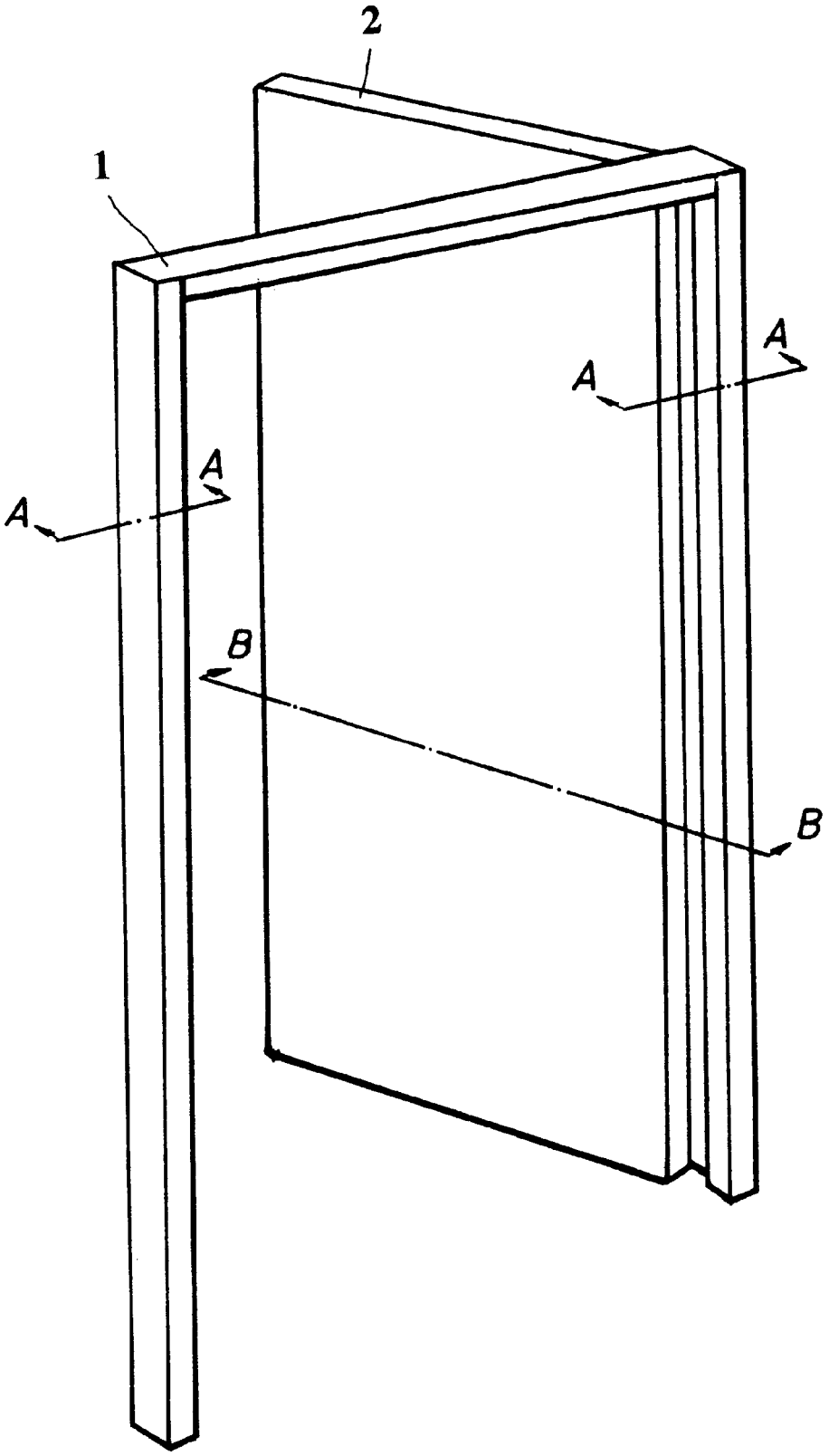
Referring to FIGS. 1, 2 and 3, the composite fire-proof, heat barrier door includes a case trim 1 and a fire-proof door 2.
Figure 2:
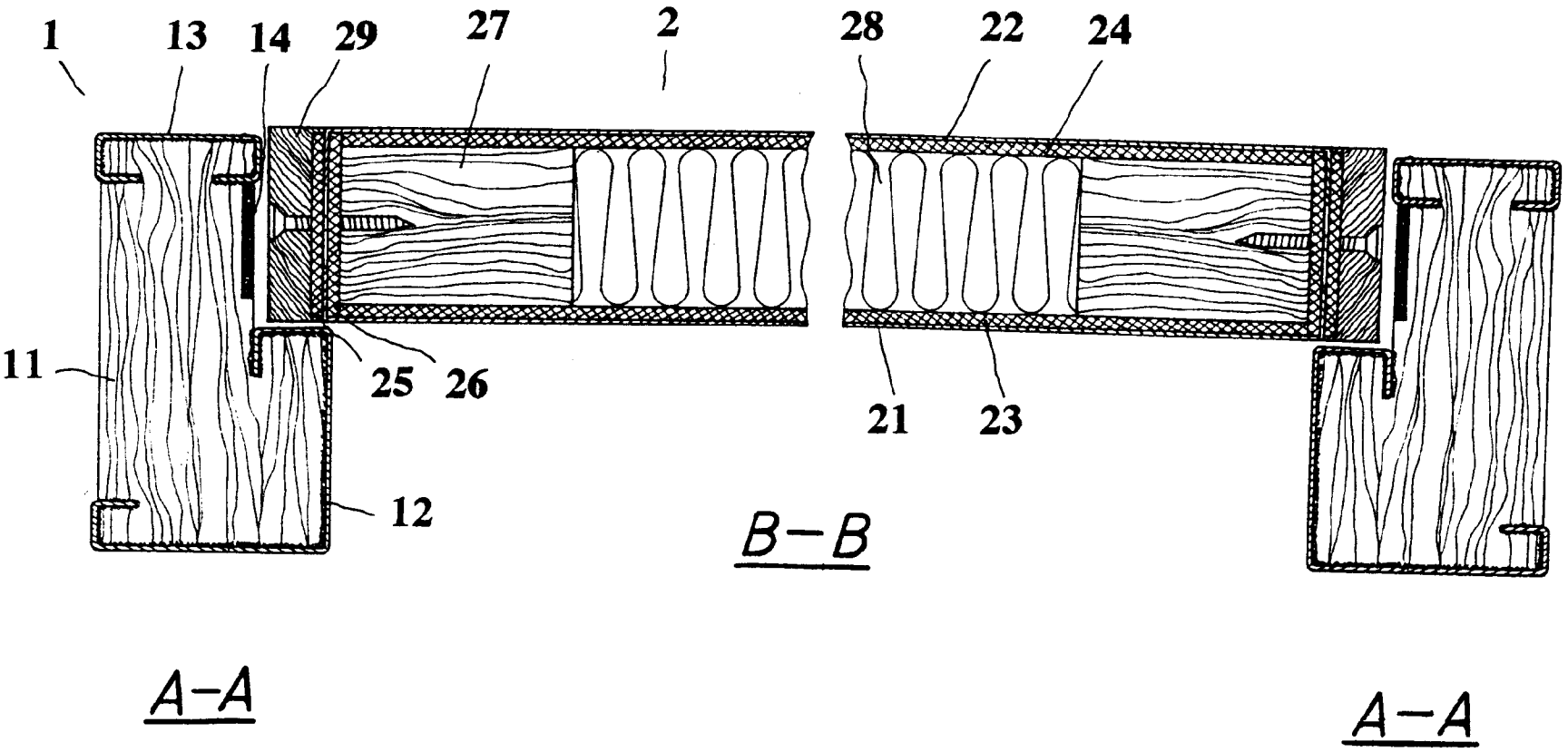
Figure 3:
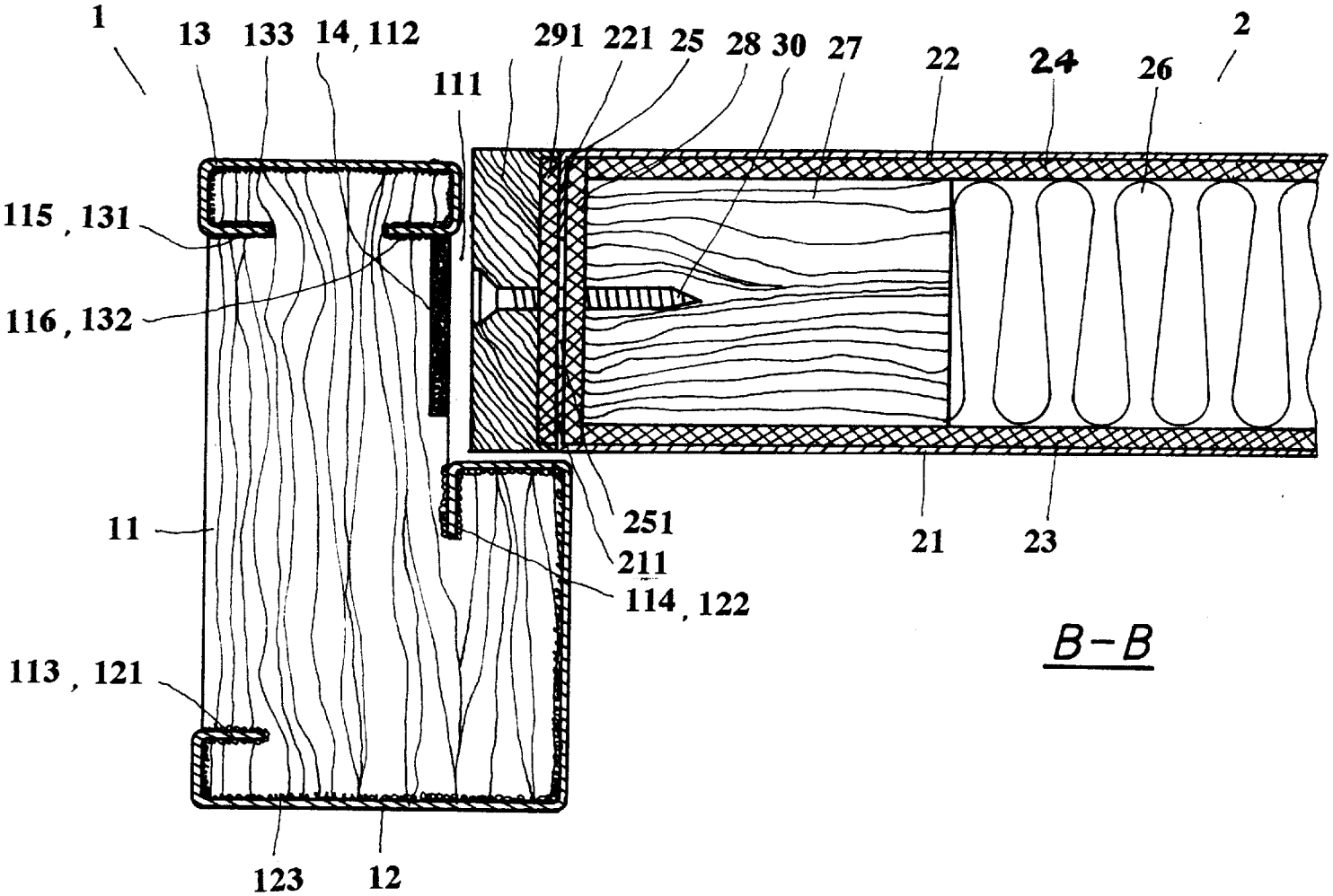

The casing trim 1 is configured with a left pillar, a right pillar and an upper pillar. The casing trim 1 is made from a wood pillar 11 laminated with protecting frames 12, 13 which are made from stainless plate, and a fire proof expanding seal 14. One end of the pillar 11 is provided with a cutout 111. In the pillar and corresponding to said cutout 111 there is provided a seal groove 112 having retained fire proof expanding seal 14 therein. The front portion of the pillar 11 is laminated with a protecting frame 12 wherein the curve portions 121, 122 are seated into the grooves 113, 114 disposed at the left side of the pillar 11 and the cutout 111. The rear portion of the pillar 11 is also laminated with a protection frame 13 wherein the curve portions 131, 132 are seated into the grooves 115, 116 of said pillar 11. In the transient area between the protecting frames and the pillar, a fire proof heat barrier expanding membranes 123, 133 are laminated thereof to protect the pillar.

The fire proof door 2 is pivoted to the casing trim with a hinge (not shown). The front and rear panels 21, 22 are made from stainless material. The peripheral of the panels 21, 22 are folded inward to form a pleat portion 211, 221. The inner wall of the panels 21, 22 are provided with rigid heat barrier fire proof plate 23, 24 which can be selected from inorganic plate made from calcium silicate, magnesium oxide, calcium carbonate. The longitudinal sides of the panel is provided with high duty fire proof foaming heat barrier plates 25, 26. Those high duty fire proof foaming heat barrier plates 25, 26 are supported with wood structure 27. The central portion of the door is provided with heat preserving material 28 such that the door is inherited with fire proof and heat barrier functions. The heat preserving material 28 can be selected from asbestos, ceramic cotton, pearl cotton or fiber glass. The peripheral edges of the door is provided with a rigid sealing plate 29 made from wood or mica plate. The rigid sealing plate 29 is provided with a groove 291 such that it can be coupled with the high duty fire proof foaming heat barrier plate 25. A plurality of screws 30 are applied to connect the rigid sealing plate 29 to the wood frame.

In the position between the curve portion 211, 221 with the inside and outside high duty fire proof heat barrier plates 25, 26, a fire proof heat barrier clearance 251 is provided. When the door is heated during a fire accident, the high duty fire proof heat barrier plates 25, 26 will be expanded to seal the clearance 251 such that the smoke and fire are prevent from coming in.

According to the provision of composite door which comprises the casing trim 1 and fire proof door 2, the wood pillars 11 of the casing trim 1 are laminated with stainless protecting frames 12, 13. On the other hand, the transient area between the pillar 11 and the protecting frames 12, 13 are also provided with fire proof heat barrier expanding membrane 123, 133, accordingly, the wood pillar can be protected completely.

On the other hand, the stainless panels of the fire proof door 2 is integrated with the rigid heat barrier fire proof plate 23, 24 and heat preserving material 28. Once a fire accident occurs, the composite door can effectively prevent the smoke and fire from coming in. The door is also provided with a fire proof heat barrier clearance 251 which can be completely closed by the high duty fire proof heat barrier plates 25, 26 once it is heated by fire. Accordingly, the smoke and fire can be completely and thoroughly isolated.

While particular embodiment of the present invention has been illustrated and described, it would be obvious to those skilled in the art that various other changes and modifications can be made without departing from the spirit and scope of the invention. It is therefore intended to cover in the appended claim all such changes and modifications that are within the scope of the present invention.

I claim:

1. A composite fire proof, heat barrier door, comprising:

a casing trim configured with a left pillar, a right pillar and an upper pillar, each of said pillars being formed of a wood pillar having front and rear pillar portions laminated with protecting frames made from stainless plate, and a fire proof expanding seal, characterized in that one end of each of said pillars is provided with a cutout, said cutout being provided with said seal groove having a retained fire proof expanding seal therein, and wherein in a transient area between said protecting frames and said respective pillars, a fire proof heat barrier expanding membrane is laminated therein to protect said respective pillars; and a door pivotally mounted to said casing trim and including front and rear panels formed of stainless plate and having longitudinal sides with peripheral edges folded inwardly, characterized in that inner walls of said front and rear panels are provided with rigid heat barrier fire proof plates, the longitudinal sides of said front and rear panels are provided with high duty fire proof foam heat barrier plates, said high duty fire proof foam heat barrier plates each being supported an a wood structure, the central portion of the door being provided with heat preserving material, the peripheral edges of said door being provided with a rigid sealing plate having a groove whereby an additional high duty fire proof foam heat barrier plate can be coupled thereto, and a plurality of screws connects said rigid sealing plate to said wood structure.

2. A composite fire proof, heat barrier door as recited in claim 1, wherein the protecting frames are provided with curved portions that are seated into grooves disposed at the left side of the pillar and the cutout.

3. A composite fire proof, heat barrier door as recited in claim 1, wherein the rigid heat barrier fire proof plate is formed from material selected from the group consisting of calcium silicate, magnesium oxide and calcium carbonate.

4. A composite fire proof, heat barrier door as recited in claim 1, wherein the heat preserving material of the central portion of the door is selected from the group consisting of asbestos, ceramic cotton, pearl cotton and fiber glass.

5. A composite fire proof, heat barrier door as recited in claim 1, wherein a clearance is provided between the inwardly folded peripheries of said front and rear panels of said door whereby when the door is heated during a fire accident, the high duty fire proof foam heat barrier plates on the longitudinal sides of said front and rear panels will expand to seal the clearance so that passage of the smoke and fire are prevented.

* * * * *